United States Patent [19]

Borsani

[11] Patent Number: 4,650,248

[45] Date of Patent: Mar. 17, 1987

[54] ADJUSTABLE CHAIR

[75] Inventor: Fulgenzio Borsani, Varedo, Italy

[73] Assignee: TECNO S.p.A. Mobili e forniture per arredamento, Milan, Italy

[21] Appl. No.: 687,600

[22] Filed: Dec. 31, 1984

[30] Foreign Application Priority Data

Dec. 30, 1983 [IT] Italy ..... 24068/83[U]

[51] Int. Cl.[4] ..... A47C 1/32

[52] U.S. Cl. ..... 297/300; 297/301

[58] Field of Search ..... 297/300, 301, 304, 305, 297/267

[56] References Cited

U.S. PATENT DOCUMENTS

| | | | |
|---|---|---|---|
| 1,829,434 | 10/1931 | Bair | 297/301 |
| 4,143,910 | 3/1979 | Geffers et al. | 297/301 |
| 4,270,797 | 6/1981 | Bräuning | 297/300 |
| 4,333,683 | 6/1982 | Ambasz | 297/300 |
| 4,380,352 | 4/1983 | Diffrient | 297/301 |
| 4,408,800 | 10/1983 | Knapp | 297/300 X |
| 4,411,469 | 10/1983 | Drabert et al. | 297/300 |
| 4,479,679 | 10/1984 | Fries et al. | 297/304 |

FOREIGN PATENT DOCUMENTS

| | | | |
|---|---|---|---|
| 1042397 | 10/1958 | Fed. Rep. of Germany | 297/305 |
| 2757349 | 7/1979 | Fed. Rep. of Germany | 297/300 |

*Primary Examiner*—Peter A. Aschenbrenner

*Attorney, Agent, or Firm*—Karl F. Ross; Herbert Dubno

[57] ABSTRACT

An adjustable chair, intended in particular for office use or similar, consists of a base equipped with a telescopic column supporting a seat, preferably padded. The seat has a rigid outer frame divided into two sections hinged together about an axis, a front section of this frame being rigidly mounted on the telescopic column and the rear section being able to tilt relatively to the front section, there being an adjustable, resilient support means acting between the front and rear sections of the outer frame. The rear section of the frame supports in a pivotal manner a seat back, preferably padded, affording a tilting action by means of an adjustable, resilient means acting between the rear section of the frame and the seat back.

5 Claims, 5 Drawing Figures

ADJUSTABLE CHAIR

BACKGROUND OF THE INVENTION

For office work, chairs and seats with height adjustment are frequently used; in addition, user comfort is enhanced if the seat can tilt gently, thus affording easy selection of the most comfortable position. Numerous types of chairs have been designed to achieve this effect; however, there is a need for a chair in which this tilt can be adjusted, with variation in hardness (degree of resiliency), and completely locked if so required, with adjustments effected by simple actions or controls.

SUMMARY OF THE INVENTION

According to the present invention there is provided an adjustable chair comprising a base, a telescopic column on the base supporting a seat, the seat having a rigid outer frame divided into two sections hinged together, a front section of which being mounted on said column and a rear section of which being able to tilt relatively to said front section, there being an adjustable, resilient supporting means positioned and acting between said two sections, and said rear section of the frame supporting in a pivotal manner a seat back, so that the seat back can tilt relatively to said frame, and there being an adjustable resilient means positioned and acting between said seat back and said frame.

DESCRIPTION OF THE PREFERRED EMBODIMENT

Figure 1:
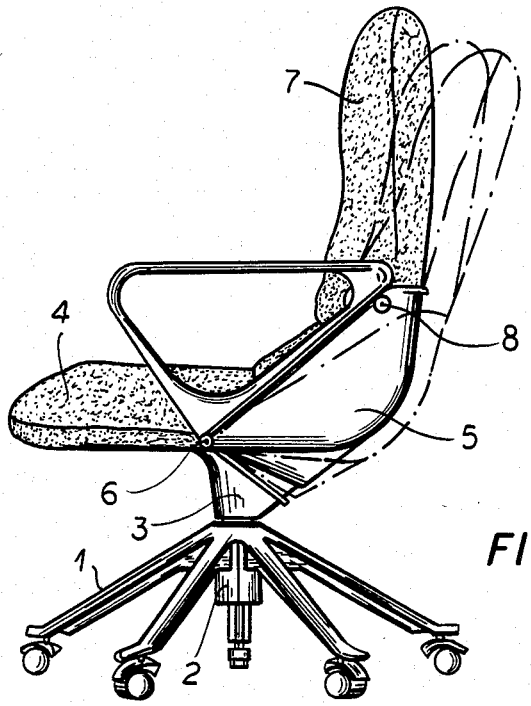
FIG. 1 is a diagrammatic view showing the present chair.

The present chair, as illustrated in FIG. 1, is intended primarily for office use and consists of a base 1 equipped with castors supporting a telescopic column 2 fitted with a pneumatic piston-and-cylinder arrangement 32 for height adjustment, on which a front section 3 of a seat frame rests, which in turn supports a padded seat 4.

A rear section 5 of the seat frame is hinged at 6 to the front section 3, the rear section 5 supporting an upper seat-back 7, which can tilt about a hinge 8.

Figure 2:
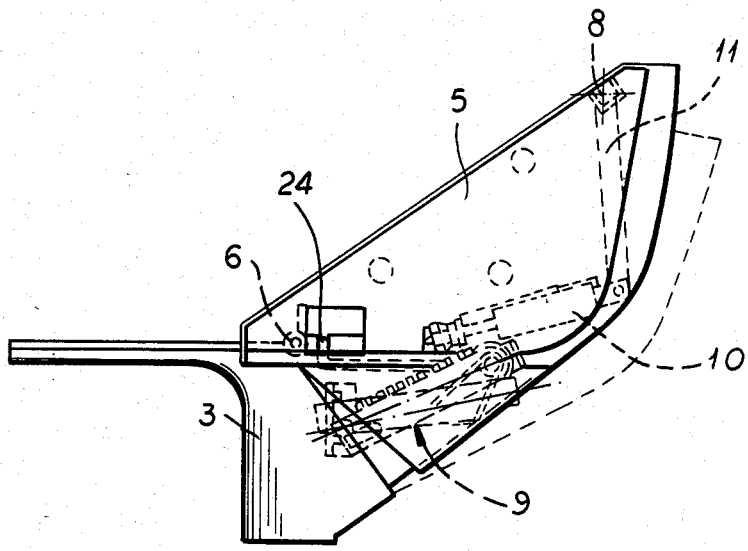
FIG. 2 is a detailed view of a seat frame of the chair shown in FIG. 1, showing in phantom another possible position of part of the frame.
Figure 3:
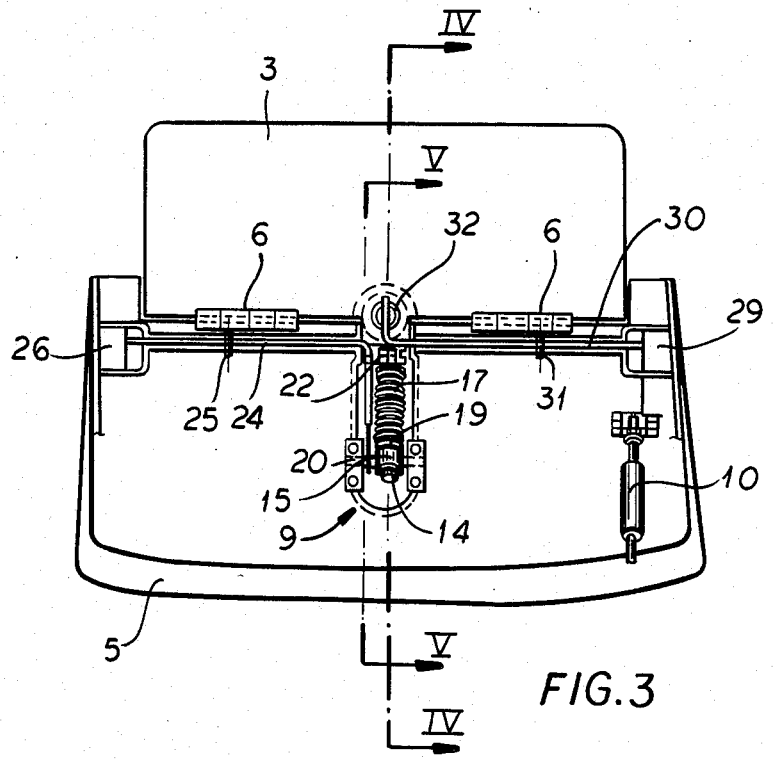
FIG. 3 is a plan view of the seat frame shown in FIG. 2.

The structure of the seat is shown in greater detail in FIGS. 2 and 3, which show the seat frame and respective front and rear sections 3, 5 without accessories. These sections 3, 5 of the frame consist of elements of a rigid material such as aluminium, a light alloy, or a reinforced plastics material. An adjustable resilient link device 9 is located between the front section 3 and the rear section 5, and this is shown in greater detail in FIGS. 4 and 5. The rear section 5 also carries an adjustable resilient supporting means in the form of a gas strut or pneumatic piston-and-cylinder arrangement 10, which is also pivotably linked to a frame 11 which supports the upper seat-back 7, thereby facilitating adjustment of the upper seat-back 7.

Figure 4:
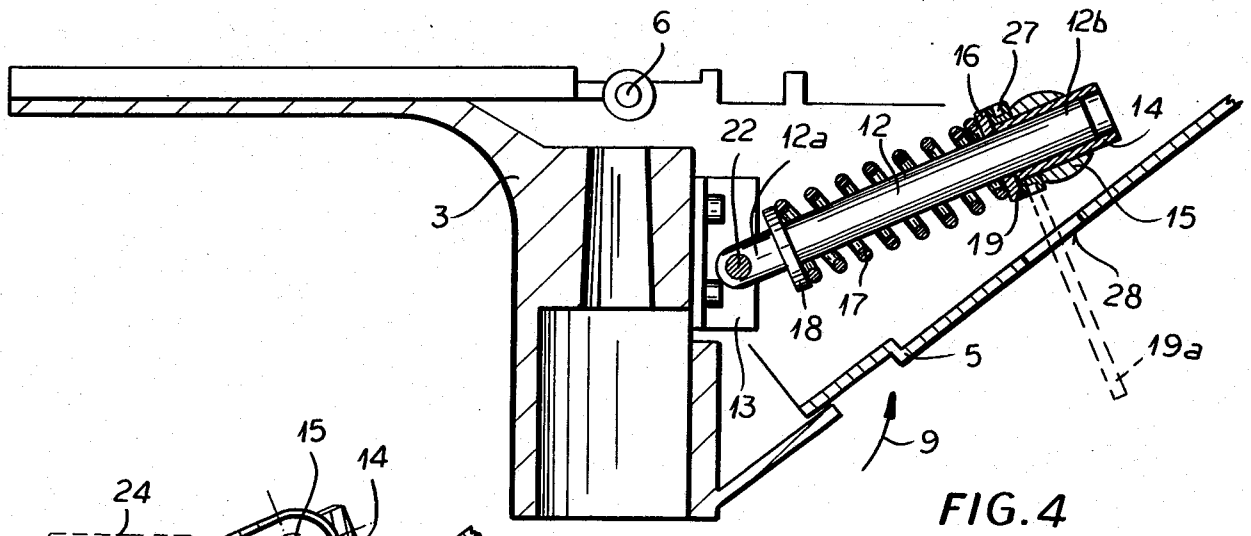
FIG. 4 is a section taken on the line IV—IV in FIG. 3.

As shown in FIG. 4, the link device 9 consists of a cylindrical guide element 12, which is hinged at one end 12*a* about a pivot pin 22 fitted in a plate 13, which is fixed to the front frame section 3. The other end 12*b* of the guide element 12 is slidably mounted inside an externally threaded sleeve 14, which is screwed in an internally threaded pivot 15, which itself is mounted on and can rotate with the rear frame section 5.

The sleeve 14 is arranged to rest at one end against a rebated ring 16 via a lock nut 19 of the sleeve 14. A compression spring 17 surrounds the guide element 12 and acts between the ring 16 and a boss 18 at the end 12*a* of the guide element 12, so that the ring 16 presses against the lock nut 19.

A bar 20 is mounted on the pivot 15 so that it is able to rotate with the pivot. The bar 20 has an L-shaped slot 21 into which the pivot pin 22 is inserted.

Figure 5:
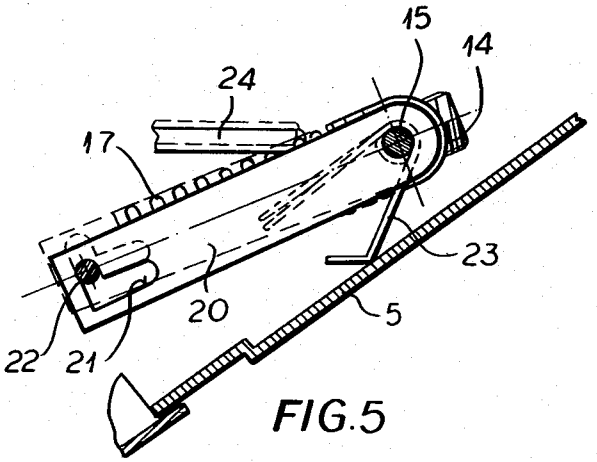
FIG. 5 is a section taken on the line V—V in FIG. 3.

A wire spring 23 is arranged to act between the structure of the rear frame section 5 and the bar 20, normally maintaining the latter in the position shown in dotted lines in FIG. 5. This position affords sliding of the pivot pin 22 in the slot 21 and this enables the seat section 5 to tilt, with consequent compression of the spring 17.

This tilting action is locked when a lever 24 acts against the bar 20, maintaining it in the position shown in full lines in FIG. 5. In this case, the pitch between the pivot 15 and pivot pin 22 is fixed, thereby preventing any tilting of the seat section 5. The lever 24, as can be seen in FIG. 3, is pivoted on a pin 25 and is linked to a plunger 26 which has access for a user from outside, on one side of the seat, for locking device control.

The threaded lock nut 19 is drilled with holes 27 around its periphery and there is an associated aperture 28 on the rear seat section 5. This makes it possible to rotate the lock nut 19, by means of a suitable small lever 19*a*, as illustrated in FIG. 4, screwing or unscrewing the sleeve 14 between the pivot 15, thus varying the degree of compression on the spring 17 and the hardness of the tilting action or effort of the rear seat section 5.

On the opposite side from the plunger 26, there is a manual operating member in the form of a plunger 29, acting on a lever 30, which is pivoted on a pin 31, affording action on a pneumatic piston-and-cylinder arrangement, contained in the column 2, thus adjusting the height of the seat.

I claim:

1. An adjustable chair comprising a base, a telescopic column on the base supporting a seat, the seat having a rigid outer frame divided into two sections hinged together, a front section of which being mounted on said column and a rear section of which being able to tilt relatively to said front section, there being an adjustable, resilient supporting means positioned and acting between said two sections, and said rear section of the frame supporting in a pivotal manner a seat back, so that the seat back can tilt relatively to said frame, and there being an adjustable resilient means positioned and acting between said seat back and said frame, said supporting means comprising a cylindrical guide element which has one end pivotably mounted on said front section of the frame and its other end slidably engaged in an externally threaded sleeve which is screwed into a pivot means itself supported on said rear frame section so as to be able to pivot therewith, there being a lock nut mounted on said sleeve in such a way as to afford rotation of said sleeve in said pivot means, and a spring inserted between said lock nut and the end of said guide element that is mounted on said front section of said frame, said chair further comprising a bar supported such that it can rotate at one end thereof on said pivot means and has a slot at the other end thereof, a pivot pin pivotably mounting said guide element to said front frame section being inserted into said slot, said slot being profiled so as to house said pivot pin in two positions, one position affording a longitudinal stroke of the pivot pin in the slot corresponding to compression in the spring, and the other position preventing this stroke, with means provided to set and maintain said bar in one or other of said positions.

2. A chair according to claim 1, wherein said means provided to set and maintain said bar in position includes a spring acting between said bar and said rear section of said frame such that one of said positions is maintained, and a lever acting in the opposite direction to this spring, operated by a plunger accessible from the outside, to move said bar against the spring bias to the other of the two positions.

3. A chair according to claim 2 and comprising a second plunger and an associated pneumatic piston-and-cylinder arrangement, said second plunger acting, by means of a connecting member, on said piston-and-cylinder arrangement for adjustment of the height of said telescopic column and thereby said seat.

4. A chair according to claim 1, wherein said adjustable resilient means acting between said seat back and said frame is in the form of a pneumatic piston-and-cylinder arrangement.

5. A chair according to claim 1, in which said seat and said seat back are padded.

* * * * *